US005240144A

United States Patent [19]

Feldman

[11] Patent Number: 5,240,144

[45] Date of Patent: Aug. 31, 1993

[54] BEVERAGE DISPENSING APPARATUS

[76] Inventor: Joseph Feldman, 8 A. D. Gordon St., Tel-Aviv, Israel

[21] Appl. No.: 740,997

[22] Filed: Aug. 6, 1991

Related U.S. Application Data

[63] Continuation-in-part of Ser. No. 461,347, Jan. 5, 1990, abandoned.

[30] Foreign Application Priority Data

Jan. 6, 1989 [IL] Israel ..... 88894
Aug. 14, 1990 [IL] Israel ..... 95362

[51] Int. Cl.[5] ..... B67D 5/00

[52] U.S. Cl. ..... 222/82; 222/83.5; 222/95; 222/105; 222/131; 222/146.6; 222/325; 222/400.7

[58] Field of Search ..... 222/81, 82, 83, 83.5, 222/88, 95, 105, 131, 132, 325, 146.6, 400.7

[56] References Cited

U.S. PATENT DOCUMENTS

| | | | |
|---|---|---|---|
| 2,219,334 | 10/1940 | Rourke | 222/131 |
| 2,557,162 | 6/1951 | Wetzel et al. | 222/105 X |
| 3,195,779 | 7/1965 | Nicko | 222/146.6 X |
| 3,270,920 | 9/1966 | Nessler | 222/94 X |
| 3,389,833 | 6/1968 | Ramis | 222/95 |
| 3,945,534 | 3/1976 | Azly | 222/105 |
| 4,081,006 | 3/1978 | Crowell et al. | 222/83.5 X |
| 4,723,688 | 2/1988 | Munoz | 222/146.6 X |
| 4,785,973 | 11/1988 | Kobe | 222/400.7 X |
| 4,796,788 | 1/1989 | Bond | 222/94 |
| 4,857,055 | 8/1989 | Wang | 222/95 X |
| 4,886,178 | 12/1989 | Graf | 222/83.5 |

FOREIGN PATENT DOCUMENTS

| | | | |
|---|---|---|---|
| 570451 | 9/1958 | Belgium | 222/95 |
| 2411318 | 10/1977 | France . | |
| 2607109 | 11/1986 | France . | |
| 2623488 | 5/1989 | France | 222/95 |
| 365964 | 11/1958 | Switzerland . | |
| 2146705 | 9/1983 | United Kingdom . | |
| 2159583 | 5/1984 | United Kingdom . | |
| 2178001 | 2/1987 | United Kingdom | 222/95 |

*Primary Examiner*—Andres Kashnikow
*Assistant Examiner*—A. Pomrening
*Attorney, Agent, or Firm*—Ostrolenk, Faber, Gerb & Soffen

[57] ABSTRACT

Apparatus for dispensing of beverages contained in deformable bottles, particularly family-size conventional PET bottles of more than one brand or taste. The apparatus comprises a housing with one or more beverage dispensing valves at the outside, an openable lid, and one or more pressure vessels with openable lid(s) thereinside. Each pressure vessel is configured to receive one or more of the bottle(s) in an upright position. A fitting is mountable to the bottle(s), and is extended by a conduit leading to the respective dispensing valve(s). Air pressure introduced into the vessel(s) cause the squeezing of the bottle(s) thereunder following discharge of the contents of the respective bottle(s) through the dispensing valve.

15 Claims, 8 Drawing Sheets

BEVERAGE DISPENSING APPARATUS

This is a continuation-in-part of U.S. patent application Ser. No. 461,347 filed Jan. 5, 1990, now abandoned.

BACKGROUND OF THE INVENTION

The present invention relates to liquid dispensers, mainly applicable for the dispensing of carbonated soft drinks, e.g. for homes, offices, restaurants, bars and the like. The major problem encountered in dispensing carbonated beverages, such as Coca Cola (TM) or beer, is the reduction of the CO2 or other gas mixture concentration dissolved therein, which adversely effects its effervescent quality, and therefore the taste of the beverage.

The same problem exists, with the consumption of the contents of a family size bottle in the home, in that if the contents are not consumed in one go, i.e. the bottle is opened and closed several times, the beverage becomes flat and unappetizing.

An attempt to solve this very problem has been disclosed in U.K. Patent Application No. 2 178 001 A (filed Jun. 30, 1986, published Feb. 4, 1987). It relates particularly to bottles made by a stretch-blowmolding process from biaxially orientated polyethylene terephthalate polymeric material (known as "PET" bottles), which are the most widely used type of bottles for soft drinks. Thus, disclosed in that publication was a device, based on mechanically squeezing a consumed bottle between opposite rigid surfaces. Such a device is, of course, only devised for private domestic purposes, that is, for the handling of one bottle at a time, and is generally cumbersome in use.

In yet another relevant U.K. Patent Application No. 2 146 705 A (filed Sept. 21, 1983, published Apr. 24, 1985) there was disclosed a dispensing unit, particularly designed for the supply of fermented beverages such as beer. The unit comprised one or more pressure vessels each having an outlet for communication with a dispensing tap. Each vessel accommodated a flexible bag containing the beverage having gas in solution. The vessels were pressurized through connection by an air compressor in the unit or from an existing fluid line and this pressurization served to ensure dissolution of the gases in the beverage and also to expel the beverage from the bags.

The beverage was normally sealed in the bags prior to loading into the pressure vessels and the pressure of dispensing burst a membrane in the port to permit the flow of beverage from the bag. Alternatively the coupling of the pipe with the port broke the membrane for dispensing. The unit further included a refrigeration system with cooling coils.

The bags, which could be of standard form made of multi-ply metallized plastics, were placed in an upside-down position.

Obviously, the use of these dispensers required special arrangements for the supply of replacement bags and their installation within the pressure vessels, rendering some unsuitable for the public at large.

Larger scale soft drinks supply installations for bars, kiosks and the like, are also known. Such commercially available carbonated beverages dispensers necessarily require the use of a CO2 pressurized reservoir, in the form of a pressurized vessel, which is used either to originally prepare the beverage by admixing syrups, water and the gas—or, in other installations, to keep the dissolved gas concentration up to the desired level.

Such installations involve considerable logistic problems as well as complexity of construction; furthermore, the use of pressurized gas vessels and the need to introduce additional quantities of gas into the liquid, often cause serious problems of foaming during the dispensing of the beverage into cups; the problem of the contents of a single bottle losing its effervescent characteristic by piecemeal consumption remains as yet unsolved.

It is thus the general object of the present invention to provide an apparatus for dispensing PET bottled stored carbonated liquids, mainly soft drinks, such as soda water or Coca Cola (TM), while avoiding the drawbacks of the above mentioned conventional installations.

It is a further object of the invention to provide a dispensing apparatus readily adapted to supply more than one sort or brand of beverages, stored in more than one brand of bottles.

It is a still further object of the invention to simplify the procedure of exchanging exhausted bottles in the apparatus.

It is a still further object of the invention to provide means for automatically connecting individual, exchanged bottles, to the installation without any further ancillary operation.

It is a still further object of the invention that the automatic connection and release of the bottles be achieved by the application of air pressure into the pressure chamber, which pressure must anyhow be supplied to further operate the apparatus.

It is a still further object of the invention to provide a plug fitting the mouth of the bottles, so that only bottles originally manufactured by authorized manufacturers will be suitable for use as replacement bottles.

It is a still further object of the invention to provide means for assuring a neat, symmetrical deformation of the bottles in order to facilitate their retrieval out of the pressure chamber, for replacement.

SUMMARY OF THE INVENTION

According to one aspect of the present invention there is provided an apparatus for dispensing of beverages contained in deformable bottles, particularly family-size conventional PET bottles, comprising a housing with one or more beverage dispensing valves at the outside, an openable lid, and one or more pressure vessels with openable lid(s) thereinside configured to receive one or more of the bottle(s) in an upright position. Fitting means are mountable to the bottle(s) extended by conduit means leading to the respective dispensing valve(s). Furthermore, it is comprising a means for introducing air pressure into the vessel(s) to cause the squeezing of the bottle(s) thereunder following discharge of the contents of the respective bottle(s) through the dispensing valve.

The piercing needle is preferably mounted to a plunger reciprocally within a cylinder provided at the inner side of the lid, said pressurized air causing the displacement of the plunger and piercing of the diaphragm by the said needle.

The reciprocating movement of the needle and associated members function to seal the beverage outlet conduit in the upper, inoperative position of the needle, and to open same after a sealed engagement is attained between the needle and the bottle plug immediately prior The said fluid is preferably liquid which is cooled by an appropriate cooling system.

The pressure vessel can accommodate bottles storing different makes or brands of liquid, each selectively dispensed by its respective discharging valve.

BRIEF DESCRIPTION OF THE DRAWINGS

These and other features of the invention will become more readily understood in the light of the ensuing description of a few preferred embodiments of the invention, given by way of example only, with reference to the accompanying. drawings, wherein.

DETAILED DESCRIPTION OF THE PREFERRED EMBODIMENTS

Figure 1:
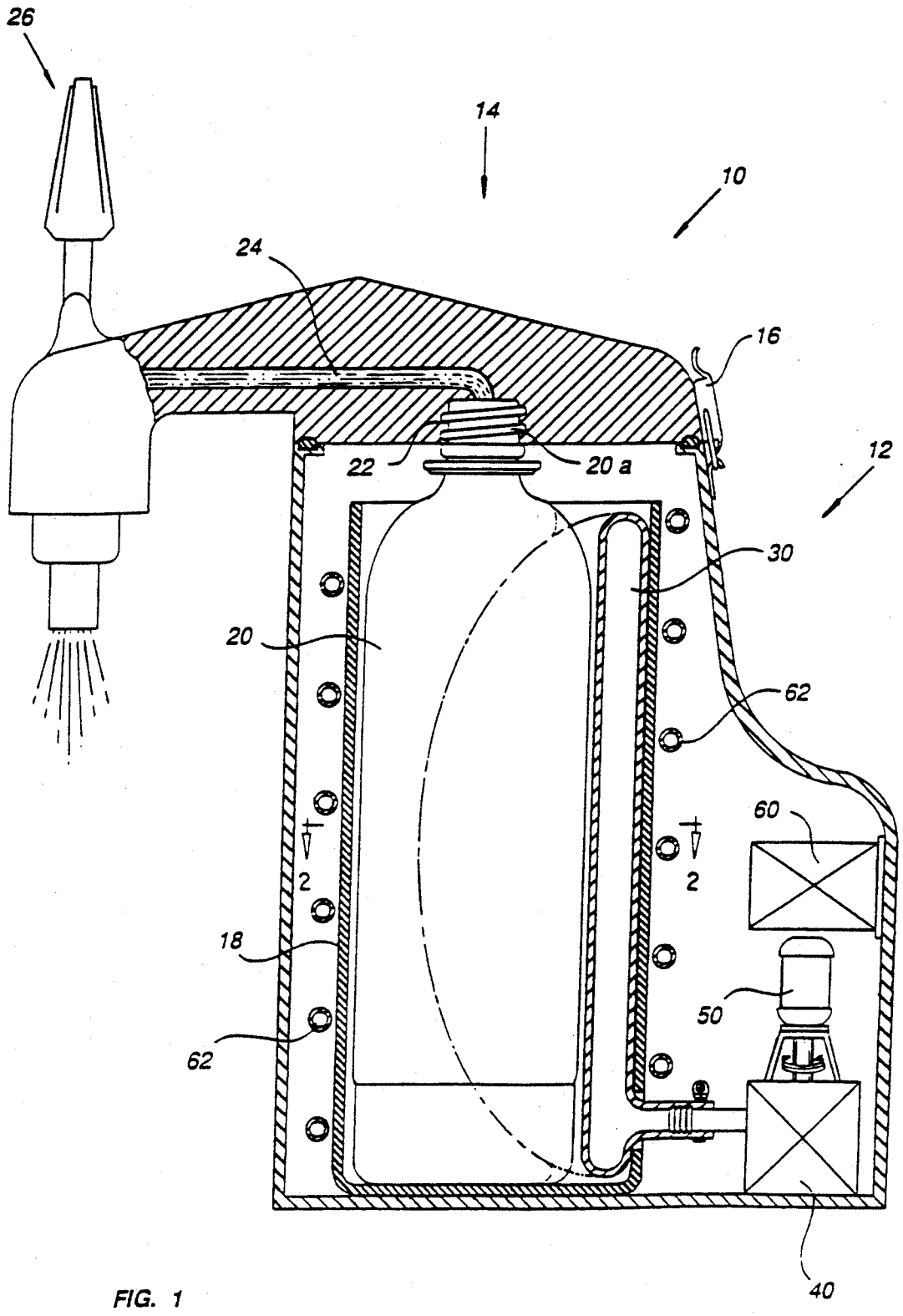
FIG. 1 is a schematic, longitudinal cross-sectional view of a device featuring the principles of the present invention according to one embodiment thereof employing an inflatable air cushion.

The dispensing apparatus, generally denoted 10 in FIG. 1 comprises a base housing portion denoted 12 and a removable head or top housing portion 14, mounted onto and sealed against the base portion 12, e.g. by clasps 16 (only one being shown).

A cylindrical, open top jacket 18 is provided within the base 12 sized to accommodate an ordinary, family size PET bottle 20 with its screw threaded neck portion 20*a* received within a female screw threaded depression 22 formed in the otherwise solid structure of the head 14.

Further comprised in the head 14 is a passage 24 leading from the depression 22 (i.e. communicating with the interior of the bottle 20) to a manipulatable dispensing valve or tap denoted 26, of any suitable type.

Within the cylindrical jacket 18, a crescent-shaped, elastic, inflatable air cushion or balloon 30 is enclosed. The cushion 30, preferably of rubber, is generally elongated and of a height substantially equal to the height of the cylindrical body portion of the bottle 20.

As further schematically shown in FIG. 1, the air cushion 30 is connected to a compressor unit 40, driven by an electric motor 50; and there is further provided a refrigeration system generally denoted 60, incorporating a cooler spiral pipe 62 surrounding the jacket 18. Preferred design details of the pneumatic, electrical and cooling systems will be given below with reference to FIGS. 3, 4 and 5, respectively.

Figure 2:
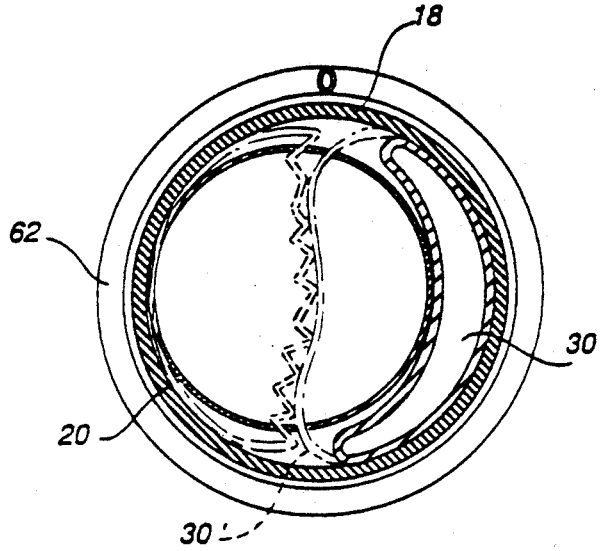
FIG. 2 is a section taken along line II—II of FIG.

The major characteristic feature of the invention will now be readily understood, namely, that after loading the device 10 with the bottle 20, and upon inflating the cushion 30 by air pressure charged thereinto by the compressor 40, and opening the valve 26, the bottle 20 will become crimped due to its readily deformable thin plastic wall, as shown in broken lines in FIGS. 1 and 2. The deformation pressure, controlled by pressostat 51 (see FIG. 4), is necessarily higher than the CO2 vapor pressure prevailing within the bottle 20.

It is thus made clear that dispensing the contents of the bottle 20, via the passage 24 by opening the valve 26, does not involve a change of the pressure within the bottle 20 or along the passage 24; this feature is most important, particularly in the case of easily foamable beverages such as Diet Coca Cola (TM) and beer, to prevent the frothing up of the beverage, as described in the preamble hereto.

As can be readily understood, the beverage can thus be intermittently consumed, without any deterioration of its quality as far as its dissolved CO2 concentration is concerned, and is supplied cool by the operation of the refrigeration system 60.

Once exhausted, exchanging of the bottle is easily performed by removing the head 14 (after deflating the air cushion 3, and releasing the clasps 16), unthreading the collapsed, flattened bottle, opening a new bottle and threading its head into the depression 22, and reassembling the unit.

Figure 3:
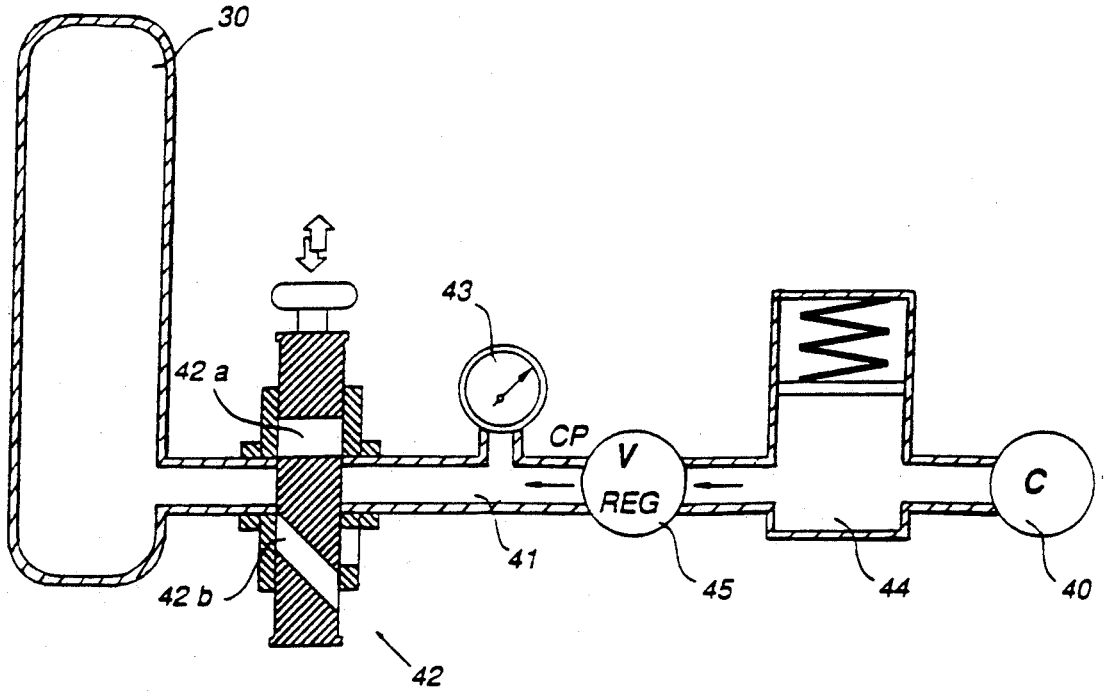
FIG. 3 is a diagram of the pressure system of the device of FIG. 1.

In FIG. 3, a preferred embodiment of the pneumatic system is diagrammatically represented. Thus, the rubber air cushion 30 is connected to the compressor 40 intermediate line 41. A selector valve 42 is provided, operable from outside the housing 12, for selectively admitting/relieving the pressure into/from the cushion 30 via passage ways 42*a*, 42*b*, respectively. Further provided are manometer 43, pressure accumulator 44, safety relief valve 45, and pressure regulating switch 51 —all according to well known design considerations and practice in equivalent systems and therefore need not be described in more detail.

Figure 4:
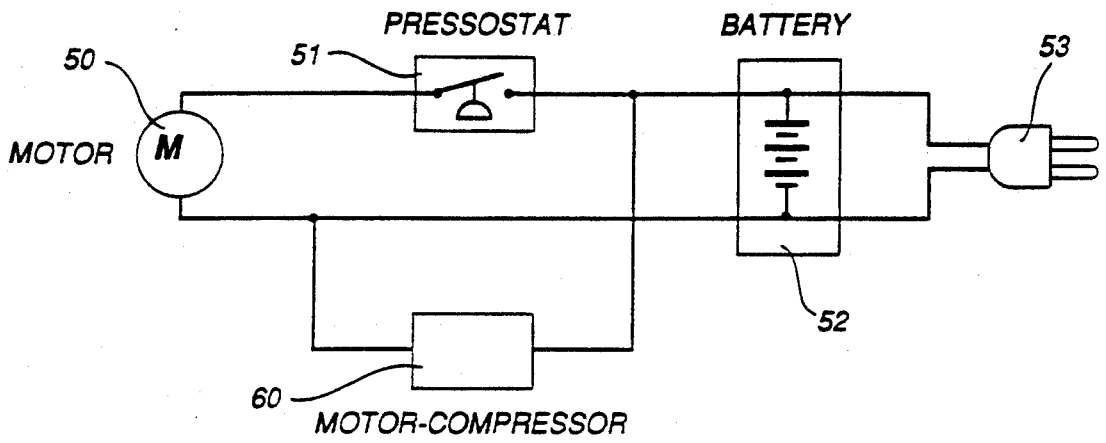
FIG. 4 is a diagram of the electrical system of the device of FIG. 1.

FIG. 4 diagrammatically shows the electrical system of the device of FIG. 1, comprising the compressor motor 50, the pressostat 51, and the refrigerator 60, connected by plug 53 to a power supply. Optionally, if the dispensing device 10 is designed to be self-contained and portable, for outdoor use at picnics or in the automobile, a chargeable battery 52 may be added.

Figure 5:
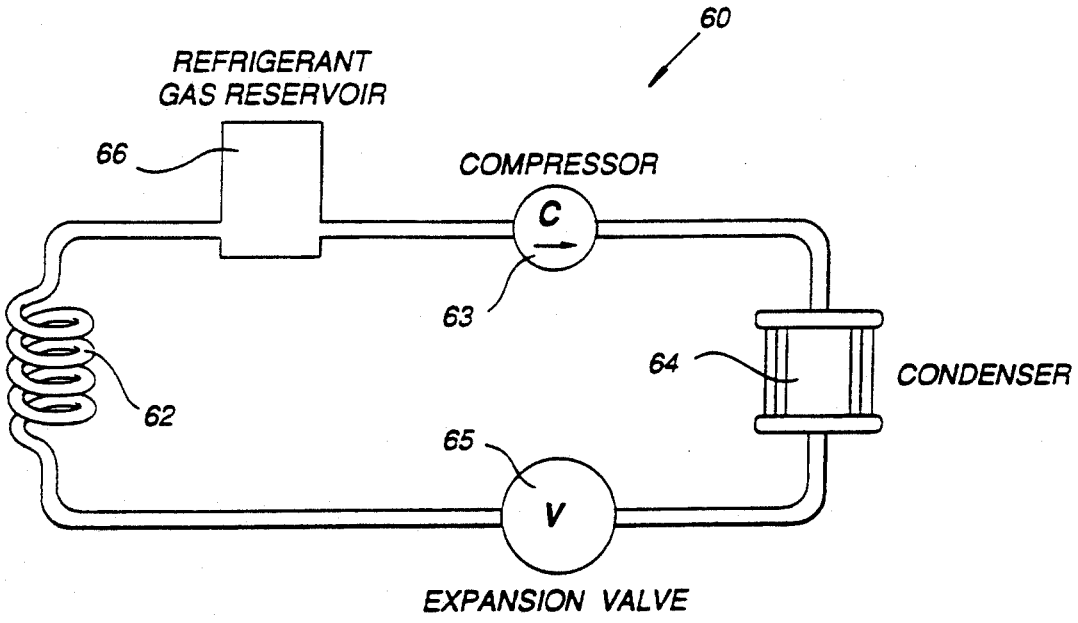
FIG. 5 is a diagram of the refrigerating system of the device of FIG. 1.

FIG. 5 diagrammatically shows the components of the refrigerating system 60, which comprises besides the compressor 63 and the cooling spiral 62, condenser 64, expansion valve 65 and refrigerant gas reservoir 66.

It should be noted that rather than pneumatically compacting the container 20, i.e. by inflating the air cushion 30, the device may be hydraulically operated in an analogous manner by filling the housing base portion 12 with water and applying air pressure above the water level. This concept is further developed in the embodiments of FIGS. 6 and 7–9.

Figure 6:
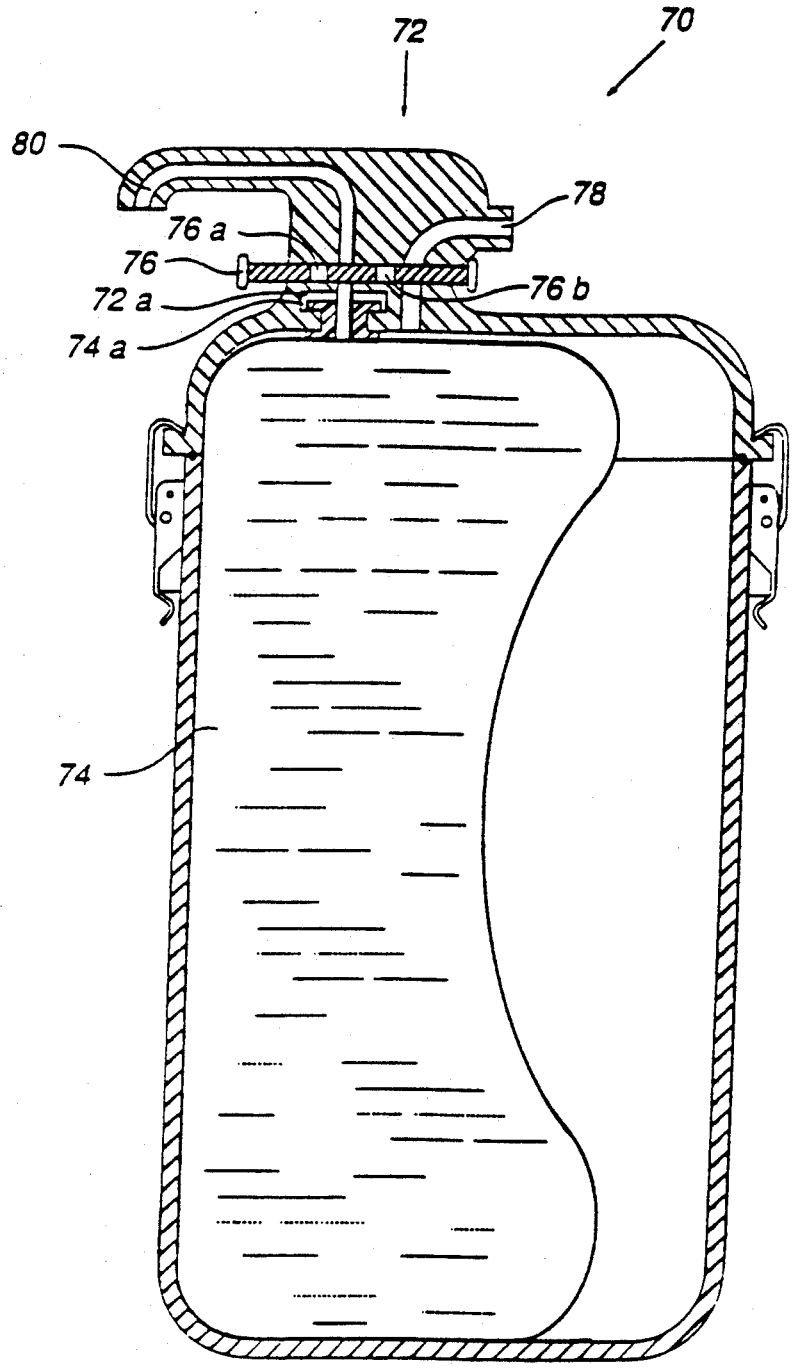
FIG. 6 illustrates direct use of pneumatic/hydraulic pressure for squeezing a container within a pressure vessel according to a second embodiment of the invention.

In the embodiment of FIG. 6 there is shown a housing 70 in any suitable form, say cylindrical or prismatic, to which there is releasable mounted a head 72. Within the housing 70 there is accommodated a container 74 made of plastic or other yieldable sheet material, with nipple 74*a* suitably insertable in a self-sealing fashion through opening 72*a*, as shown. A slidable valve spool 76 is provided, having a first passage 76*a* and a second passage 76*b*, adapted to be manipulated into one or other extreme positions such that the passages are either in communication with pressure fluid inlet port 78 and discharge or dispensing passage 80—or disconnected therefrom. The inlet port 78 is connected to a hydraulic or pneumatic pressurized fluid source (not shown) constituted by a water pump (or even the municipal water mains), or an air compressor.

When the spool 76 is switched over to its communicating state (in the righthand direction), pressure is introduced, via passage 76*b*, into the housing 70, for compacting the beverage container 74, whilst passage 76*a* becomes open for the discharge of the liquid contents under the applied hydrostatic pressure.

Figure 7:
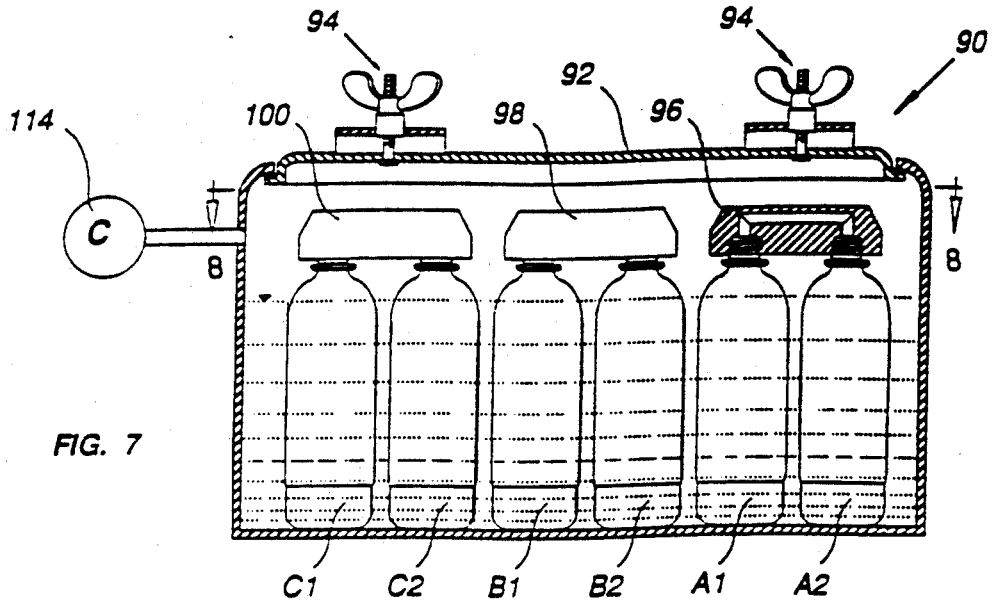
FIG. 7 is a schematic, cross-sectional view of a pressure vessel containing a plurality of family-size, soft-drink bottles.
Figure 8:
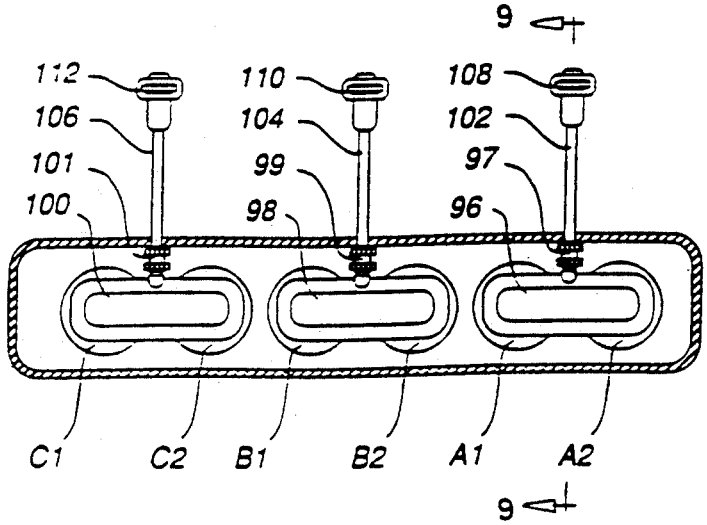
FIG. 8 is a section taken along line VIII—VIII of FIG. 7.
Figure 9:
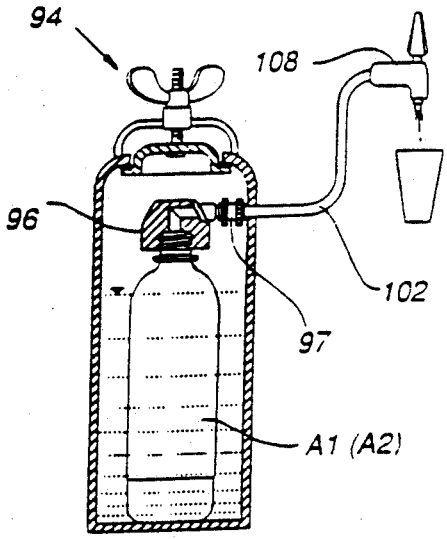
FIG. 9 is a section taken along line IX—IX of FIG. 7.

In FIGS. 7–9 a further developed embodiment of the device is illustrated, designed for use with ordinary PET bottles of soft drinks. There is provided a pressure vessel 90 with an openable lid 92, which may be sealed against the inner side of the top opening of the vessel 90 by screw tightened closing devices designated 94, of a known design. The vessel 90 contains three pairs of family size PET bottles, denoted Al and A2, B1 and B2, Cl and C2, connected to each other by brackets 96, 98, 100. The brackets are provided with female screw threaded recesses configured to receive the mouths of the bottles, thereby establishing communication therebetween, as clearly shown with respect to the bottles Al and A2 and the bracket 96. The brackets are connected to their respective dispensing taps, namely bracket 96, via quick coupling 97 and line 102 to tap 108, and so forth.

The vessel 90 is filled with water, and charged with pressurized air by a compressor unit 114, as schematically shown. Under the constantly maintained hydrostatic pressure of the water, each one of the bottles tends to become squeezed, such that its contents can be discharged through its respective valves 108–112 when opened. In this manner, a plurality of soft drinks of different tastes can be dispensed by one and the same device.

Exchanging of bottles—once emptied—involves the relief of the pressure from the vessel 90, disconnecting the coupling, and retrieving the used, compacted bottles with their common bracket for replacement by a pair of fresh, full bottles.

Figure 10:
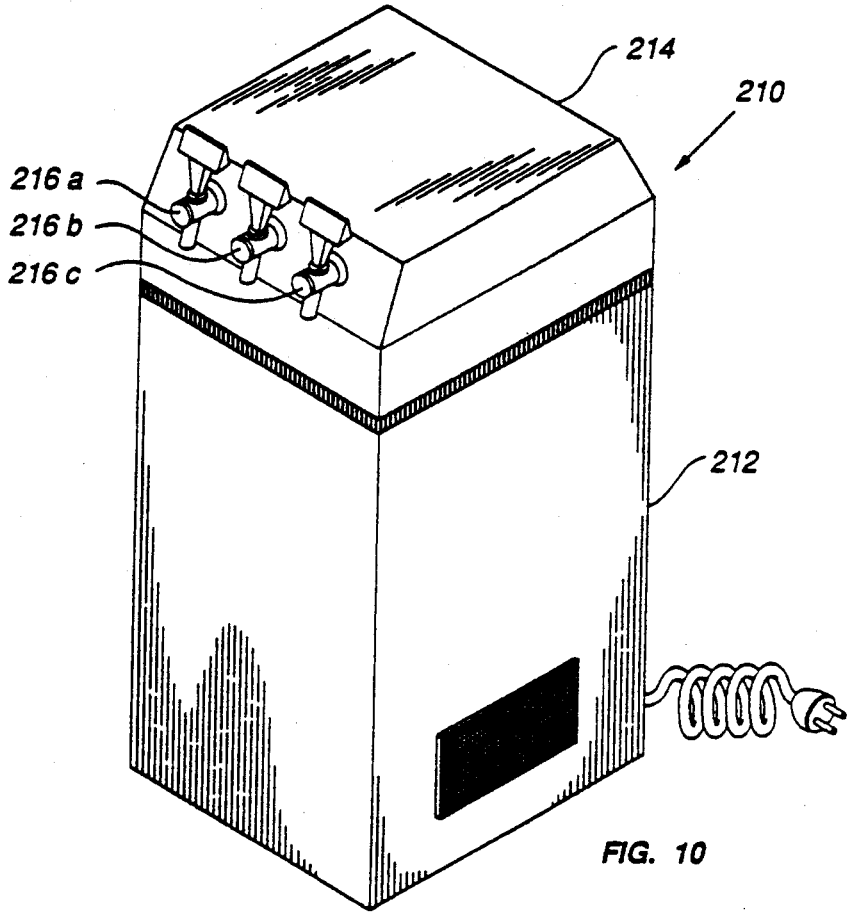
FIG. 10 illustrates a producible, self-contained dispenser apparatus accommodating bottles of three different tastes.

As shown in FIG. 10 the apparatus denoted 210 is generally box-shaped having base housing section 212 and a top housing section 14. The top section 214 is provided with one or more (three in the illustrated example) dispensing taps or spouts 216*a*, 216*b*, 216*c*, each adapted to dispense a different sort, taste or brand of carbonated drink. The apparatus 210 includes a plurality of pressure chambers immersed in water cooled by refrigerating means and having the necessary connections to a source of pressurized air, water and electricity as required for its operation, all as hereinbefore described.

Figure 11:
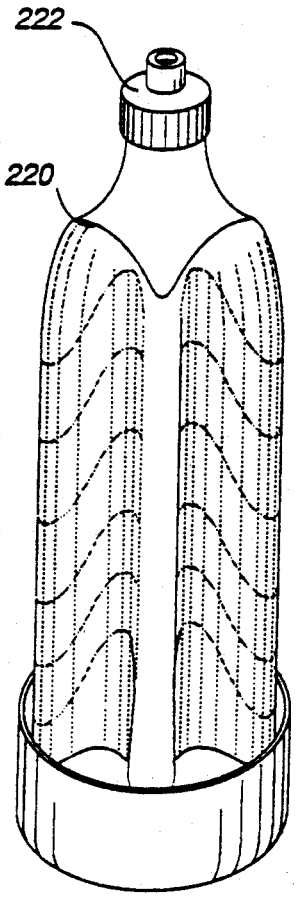
FIG. 11 illustrates the final state of an exhausted bottle with a novel bottle plug or stopper according to a still further embodiment of the invention.

FIG. 11 shows a bottle 220 having been squeezed and exhausted by use of the apparatus 210 (see FIG. 13), namely being a PET bottle 220, provided however, with a screw-on cap or plug 222 of a special design, details of which will be given below.

Figure 12:
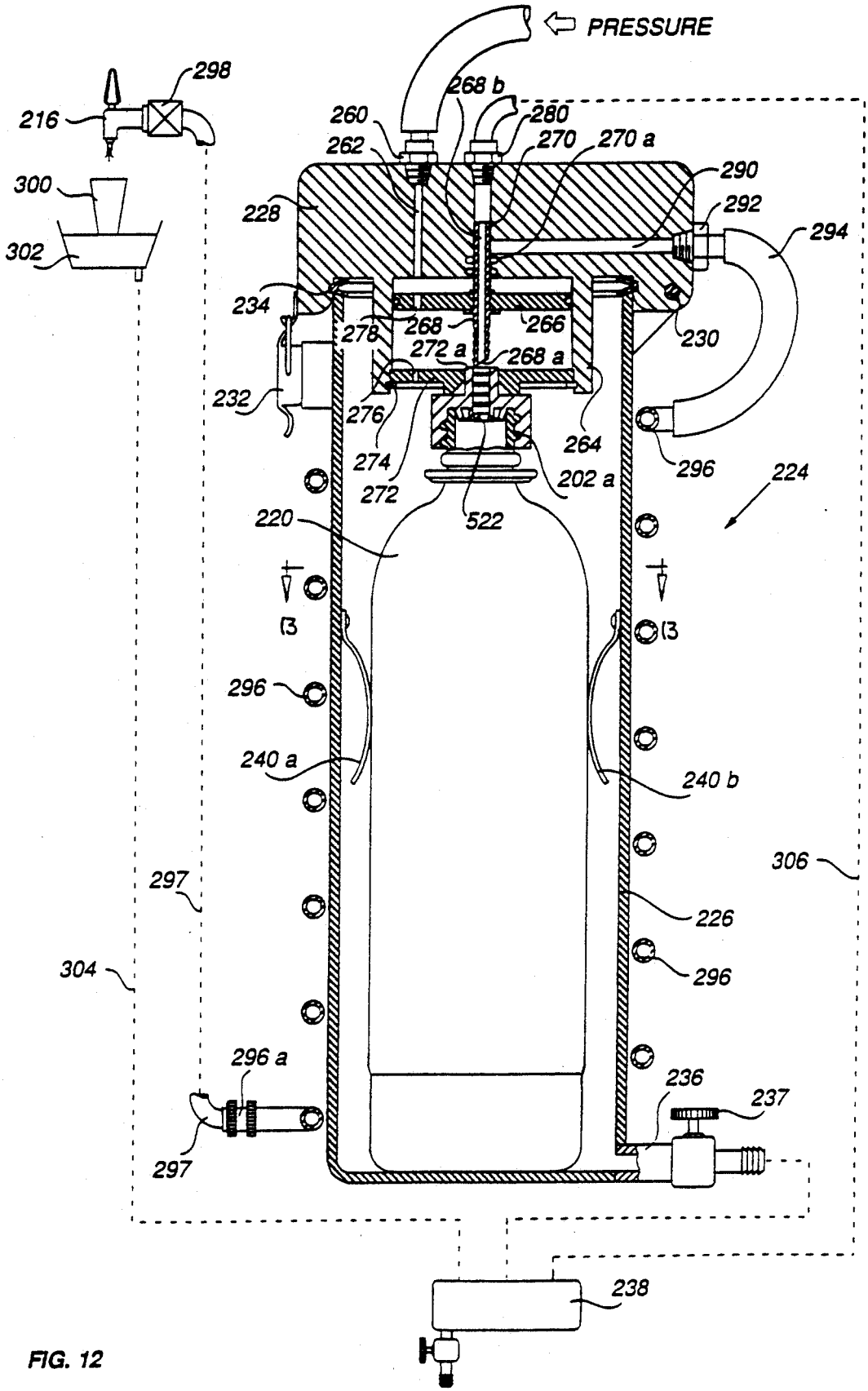
FIG. 12 is a longitudinal cross section of a pressure chamber of an apparatus using plugged bottles as shown in FIG. 11.

Turning now for more detail to FIG. 12, each one of the pressure chamber, generally designated 224, is in the form of the cylindrical vessel 226 with a lid 228 hinged to the vessel 226 by pin 230. A clasp or other locking device 232 is provided for closing the lid, and seal ring 234 is provided to seal the lid 228 onto the vessel 226.

The vessel further contains a drain outlet 236 with tap 237 connected to drain accumulating reservoir 238.

Figure 13:
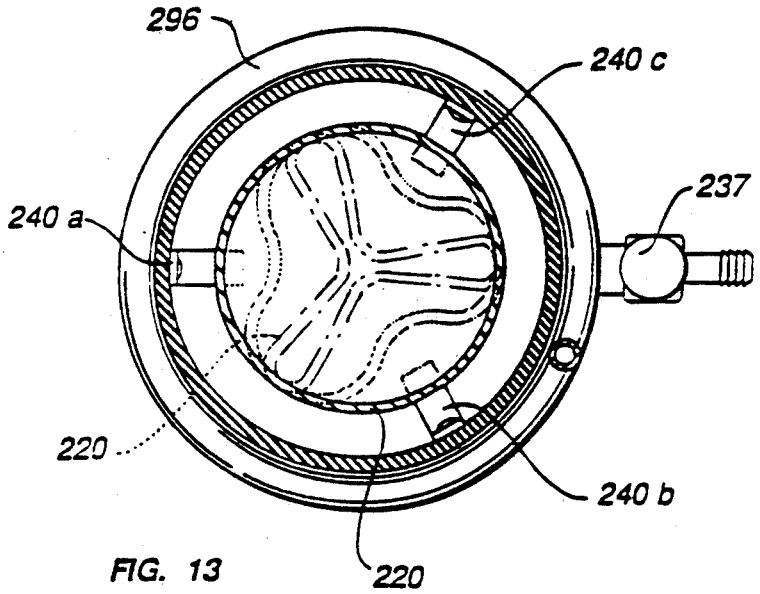
FIG. 13 is a section taken along line XIII—XIII of FIG. 12.

PET bottle 220, filled with beverage, normally carbonated soft drink and closed by the plug 222, is placed within the vessel 226 of the chamber 224, and is preferably centered by three leaf-springs 240*a*, 240*b*, 240*c* (see FIG. 13). This arrangement is recommended for a further object, namely to allow insertion of bottles having different volumes into one and the same vessel (e.g. of 1, 1 ½, or 2 litres.).

Figure 14:
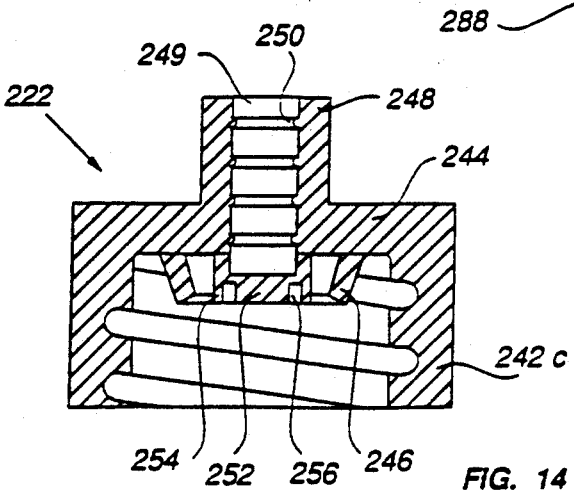
FIG. 14 is an enlarged cross sectional view of the bottle plug shown in FIG. 12.

As seen in greater detail in FIG. 14, the plug 222 is made of a yieldable material such as plastics and comprises a first section 242 with female screw thread fitting the thread of the bottle 220. The top cap section 244 comprises a cone shaped sealing lip 246 to assure the sealing of the bottle mouth 220*a*. There is further provided a cylindrical, open-top portion 248 with an inner bore 249, preferably provided with integrally formed sealing ribs 250. The bore 249 is closed at its bottom by a rupturable diaphragm 252, preferably attached to the section 244 through weakened, tearing line 254 which may by attained by providing a circular recess 256, as shown.

As already mentioned, this special type of capped bottle plug is considered to be advantageous in the context of the present invention, since only bottles originally filled and offered for sale by an authorized beverage manufacturer may be employed for use with the apparatus 210. Such a manufacturer, engaged also in the promotion and distribution of the apparatus, will be thus assured that only bottles of its production will fit for use by the owners of the apparatus.

Evidently, other types of caps could be designed, fulfilling the requirements as further detailed below.

Referring back to FIG. 12, it is shown that the lid 228 is provided with an inlet fitting 260 connected to a pressurized air source of the apparatus (not shown) leading through a bore 262 to the other side of the lid 228. Centrally located and projecting from the inner side of the lid 228, a cylinder 264 is formed. Within the cylinder a plunger 266 is reciprocable, carrying a hollow piercing needle 268 having a pointed end 268*a* and a tubular portion 268*b* sealed inside bore 270 by 0-rings 270*a*.

The bottom side of the cylinder 264 is simply closed by a cover 272 with a central opening 272*a* which fits the outer diameter of the tubular portion 248 of the cap 222 (FIG. 14). The bottom plate 272 freely rests within the bore of the cylinder 264, secured by a split-ring 274. If necessary, orifice 276 is made as shown and, likewise, an orifice 278 is provided passing through the plunger 266.

Figure 15:
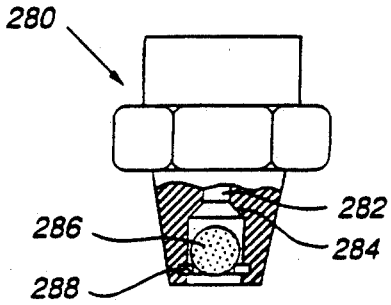
FIG. 15 is a fragmental view of a check valve provided on the pressure vessel lid as shown in FIG. 12.

Further provided on the lid is a check-valve 280 details of which are better seen in FIG. 15. Hence, the check valve 280 has a through-going bore 282, a valve-seat seat section 284 and a valve member 286 in the form of a ball, which ball is made of a light weight, floatable material. The ball is retained in its downward, gravity-induced position against split-ring 288.

Finally, the lid is provided with a third passage 290 leading to an outlet fitting 292 of the lid 228, from which it is carried by a flexible hose section 294 into a coil pipe 296 surrounding the vessel 226. From the other end 296*a* of the pipe 296, the beverage is fed by conduit 297 to one of the spouts 216. Preferably, a pressure regulated one-way valve 298 is provided to prevent the ingress of air into the conduit 297 in the reverse direction, should pressure within the system drop below a predetermined value. This is important in view of the fact that any penetration of air into the system will cause foaming of the carbonated beverage, which is considered to be a significant problem in the current art of carbonated beverage dispensers.

The beverage is served into cups or the like denoted 300 placed upon a sink 302. The sink is connected to the drain collector 238 by line 304 as shown. The check valve 280 is also connected by conduit 306 to the drain 238.

Figure 16:
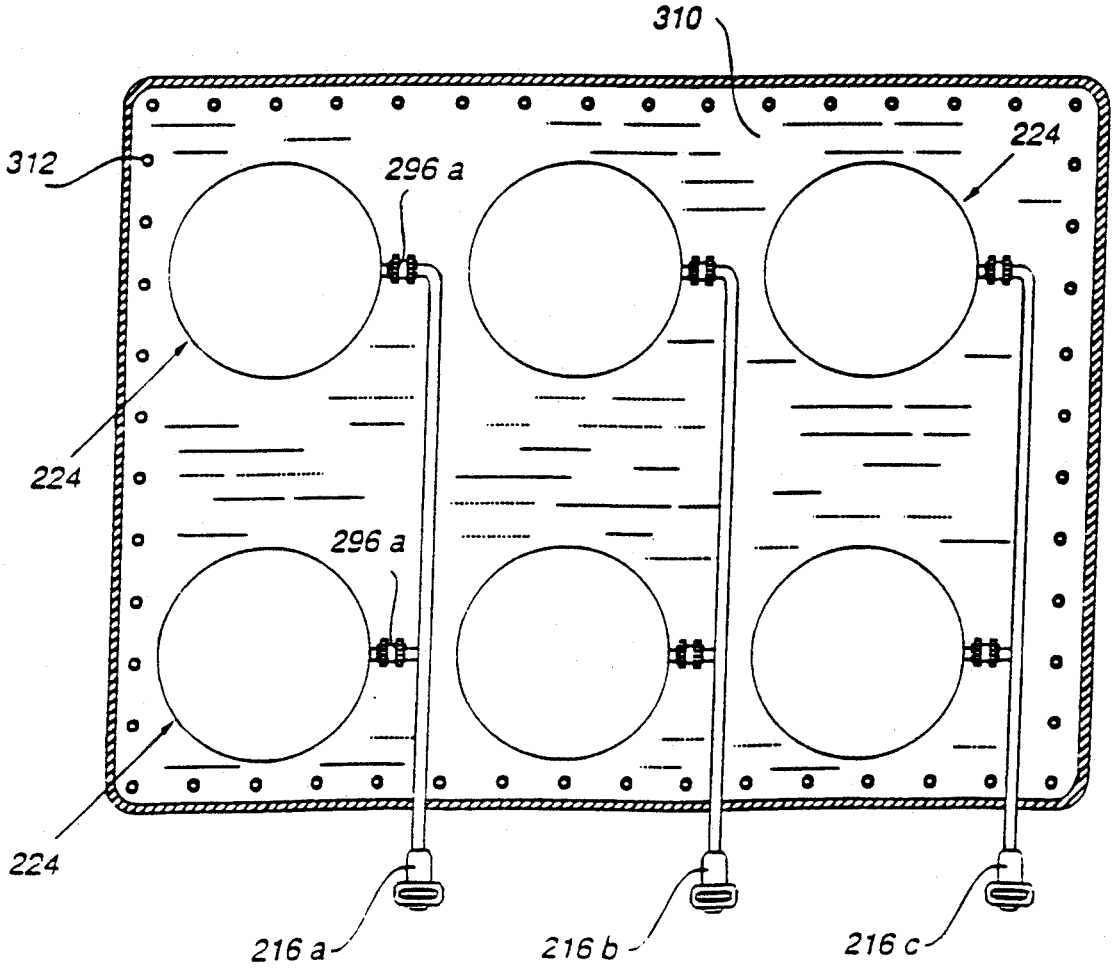
FIG. 16 is a schematic, cross-sectional top view of the inner assembly of the apparatus of FIG. 10.

As further seen in FIG. 16, the pressure vessels 224 are arranged in pairs, three pairs are shown, connected in parallel by header conduit (not shown) to their common dispensing valve (such as 216), all vessels being immersed in water 310 cooled by coil 312 of the refrigeration system (not shown).

Operation of the apparatus will now be briefly described.

Bottle 220 with the cap 222 is placed within the vessel 226 while the lid 228 is. The central location of the bottle is ensured by springs 240. Once the lid 228 is closed and locked by the clasp 232 the piercing needle becomes located in vertical alignment with the bore 249 of the cap 222. Pressure is admitted to the system through bore 262. The pressure will first build up within the space above the plunger 266. Due to the tiny passage presented by the orifice 78, some pressure will leak to the other side of the plunger 266, nevertheless the plunger as a whole will descend, first clearing the passage 290 and, upon descent, rupture the diaphragm 252. At first, the needle 268 communicates with the check valve 280 and later on, after passage 290 is gradually opened, also with the outlet 292. It should now be evident that the check valve is installed to release a certain amount of compressed CO2 (perhaps also a small amount of air) which is inevitably found at the top of every bottle.

Simultaneously, as vessel 226 becomes pressurized and the bottle 220 thereby squeezed, a small amount of the liquid beverage will begin to flush upwards, filling both the passages leading to the check valve 280 and to the outlet 292. At this point the check valve starts to operate, namely the floatable ball 286 thereof will close against the valve seat 282 and force the beverage to flow only through outlet 292. In the meantime, as pressure continues to be supplied through orifice 278, orifice 276 and/or around the plate 272, vessel 226 will continue to become pressurized thereby effecting the squeezing operation of the bottle 220 until an equilibrium state is attained between the pressure within the vessel 226 and the pressure source.

This equilibrium is maintained until the respective valve 216 is opened, resulting in delivery of a certain quantity of the beverage, causing a pressure drop within the vessel 20. Under the continued pressure introduced, the bottle will be gradually squeezed, initially at the three points of contact by the leaf springs 240, thereby attaining the star-shape deformed state shown in FIG. 13.

After complete exhaustion of the bottle 220 (see FIG. 11), incoming pressure at the pressure inlet 260 may be relieved and the respective vessel be vented. As a result, the relatively high ambient pressure trapped and prevailing within the vessel 226, will act in the opposite direction so as to displace the plunger 266 upwards. The needle will retract from the bore 249 of the cap 222 and resume its uppermost position, where its upper end 268*b* seals the passage 290. After the pressure is relieved from the vessel 226, the lid can be opened, the spent bottle may be retrieved and disposed of, and a new bottle charged; the cycle of dispensing its contents is then repeated in the same manner.

The bottle replacing procedure is thus made most simple and convenient, not involving any ancillary operations such as opening of the bottle, mounting of special adaptors, and the like.

Those skilled in the art will readily appreciate that many variations, modifications and changes may be applied to the invention as herein exemplified without departing from its scope as defined in and by the appended claims.

What is claimed is:

1. An apparatus for dispensing of beverages contained in deformable bottles, comprising:

a housing with at least one beverage dispensing valve at the outside, an openable lid, and at least one pressure vessel with an openable lid thereinside, the at least one vessel being configured to receive at least one bottle in an upright position;

a fitting mountable to said at least one bottle, the fitting comprising a plug for the opening into said at least one bottle, the plug having a tearable diaphragm, the at least one vessel lid being provided with a piercing hollow needle adapted to rupture the diaphragm when the needle is forced into the plug, a conduit leading from said fitting to said at least one dispensing valve; and means for introducing pressurized air into said at least one vessel to cause the squeezing of said at least open bottle therein for causing discharge of the contents of said at least one bottle through the said at least one dispensing valve.

2. The apparatus as claimed in claim 1 wherein the plug of said fitting further being a screw-on plug for closing the at least one bottle opening.

3. The apparatus as claimed in claim 1 wherein the needle is mounted to a plunger which is reciprocally movable within a cylinder provided at the inner side of the at least one vessel lid, and the pressurized air causes the displacement of the plunger and piercing of the diaphragm by the needle.

4. The apparatus as claimed in claim 3 wherein the plunger comprises air pressure restricting means for allowing passage of the air under pressure into the at least one vessel only upon completion of piercing of the diaphragm.

5. The apparatus as claimed in claim 4 the pressure restricting means comprise an orifice extending through the plunger.

6. The apparatus as claimed in claim 5 wherein the at least one pressure vessel is in the form if a cylindrical vessel and the at least one pressure vessel lid is hinged thereto.

7. The apparatus as claimed in claim 6 wherein the needle extends and fits into a guide bore formed in the at least one vessel lid, the guide bore branching into a first passage leading to the at least one dispensing valve, and a second passage provided with a check valve.

8. The apparatus as claimed in claim 7 wherein the first passage has an entrance located such that it is opened or closed by the displacement of the needle beyond a predetermined distance of its stroke.

9. The apparatus as claimed in claim 8 wherein the check valve is responsive to shut the second passage against liquid flowing upstream thereof.

10. The apparatus as claimed in claim 9 wherein the check valve comprises a ball valve member, valve member retaining means for retaining the valve member and a valve seat located above the valve member when the valve member is resting against the retaining means, the ball valve member being of a light-weight, floatable material.

11. The apparatus as claimed in claim 2 wherein the plug is made of plastic, having a first section with a female screw thread conforming to the screw thread of the at least one bottle mouth, a partition section overlying the first section, a circular slit defining a tearing line of the diaphragm, and a second section extending upright of the diaphragm forming a sealed sliding guide passage for the piercing needle.

12. The apparatus as claimed in claim 2 wherein the at least one vessel is immersed in cooled water, and a cooling coiled pipe surrounds the at least one vessel for cooling the beverage.

13. The apparatus as claimed in claim 12 wherein said at least one vessel is provided with means for centering the position of the at least one bottle thereinside.

14. The apparatus as claimed in claim 13 wherein the centering means comprise at least three leaf springs equally distanced from each other for engaging the at least one bottle, such that the at least one bottle is squeezed at the contact points thereof by the springs into a star-shaped deformed state.

15. The apparatus as claimed in claim 1, wherein the conduit is in the at least one vessel lid.

* * * * *